United States Patent [19]

David

[11] 4,285,067

[45] Aug. 25, 1981

[54] SHOULDER PROTECTOR

[76] Inventor: Nel E. David, 924 Lincoln Rd., Miami Beach, Fla. 33139

[21] Appl. No.: 128,097

[22] Filed: Mar. 7, 1980

[51] Int. Cl.[3] ..... A41D 27/12

[52] U.S. Cl. ..... 2/46

[58] Field of Search ..... 2/46–49

[56] References Cited

U.S. PATENT DOCUMENTS

| | | | |
|---|---|---|---|
| 1,497,685 | 6/1924 | Hoyme | 2/69 |
| 3,833,937 | 9/1974 | Taylor | 2/46 |
| 4,050,099 | 9/1977 | David | 2/46 |

*Primary Examiner*—Doris L. Troutman

*Attorney, Agent, or Firm*—Harvey B. Jacobson

[57] ABSTRACT

A shoulder protector is disclosed for use on either shoulder of a person using the device and including a layer of absorbent material exposed upwardly to receive and absorb liquid material such as that discharged by an infant when being burped. The protector includes a layer of liquid impervious material underlying the absorbent layer to protect the garments worn by the person using the protector. The protector is constructed of flexible material, fitted to the shoulder area of the person using the device and is provided with securing devices to retain the protector in place. The inner edge of the protector extends downwardly both forwardly and rearwardly of the shoulder and toward the opposite waste region with the ends of the inner edge being connected together to retain the protector in position and the outer edge of the protector being arcuately curved and fitted to the shoulder and extending laterally outwardly sufficiently to cover the shoulder region of the person using the device.

1 Claim, 3 Drawing Figures

SHOULDER PROTECTOR

BACKGROUND OF THE INVENTION

1. Field of the Invention

The present invention generally relates to a shoulder protector in the form of a generally elongated flexible member having liquid absorbent characteristics and liquid impervious characteristics for positioning securely on the shoulder of a person when burping an infant so that any liquid discharge from the mouth of the infant will be absorbed and prevented from coming into contact with the garments being worn by the person using the protector and to protect the infant from infection and contamination which may occur when the infant's mouth region comes into contact with a soiled garment or the like.

2. Description of Relevant Art

My prior U.S. Pat. No. 4,050,099, issued Sept. 27, 1977, discloses a shoulder protector for similar purposes which performs satisfactorily and which includes multiple layers of material secured together and including a unique structure for fitting the shoulder and for retaining it in position. In addition to the above patent, the following patents are exemplary of the developments in this field of endeavor.

U.S. Pat. Nos: 1,201,701—October 1916—Crane; 2,482,182—September 1949—Henninger; 2,499,689—March 1950—Sossamon; 2,617,105—November 1951—Backman; 2,727,239—December 1955—Simon; 2,793,367—May 1957—Hart; 2,831,19—April 1958—Terry; 2,955,293—October 1960—Peterson.

SUMMARY OF THE INVENTION

An object of the present invention is to provide a shoulder protector shaped to fit over and protect the shoulder of a person using the device with the protector including an upwardly exposed layer of liquid absorbing material having a layer of liquid impervious material disposed in underlying relation thereto for absorbing liquid which may be discharged from an infant's mouth when being burped and preventing such liquid from coming into contact with the garments of a person using the protector.

Another object of the invention is to provide a shoulder protector in accordance with the preceding object in which the liquid impervious layer is of plastic material and the absorbent layer is constructed of paper or cloth material having at least the edge portions of the layers bonded together by heat sealing, stitching, or the like, thereby providing a relatively inexpensive protector.

Still another object of the invention is to provide a shoulder protector having an over-all elongated configuration with arcuately curved edge portions and longitudinally extending narrowed ends in the form of straps, or the like, for securing the protector in position with the curved edges being constructed to shape the protecter so that it will fit the contours of the shoulder region thereby enabling the protector to be securely retained in position by various fastening and securing arrangements.

These together with other objects and advantages which will become subsequently apparent reside in the details of construction and operation as more fully hereinafter described and claimed; reference being had to the accompanying drawings forming a part thereof, wherein like numerals refer to like parts throughout.

DESCRIPTION OF THE PREFERRED EMBODIMENT

Figure 1:
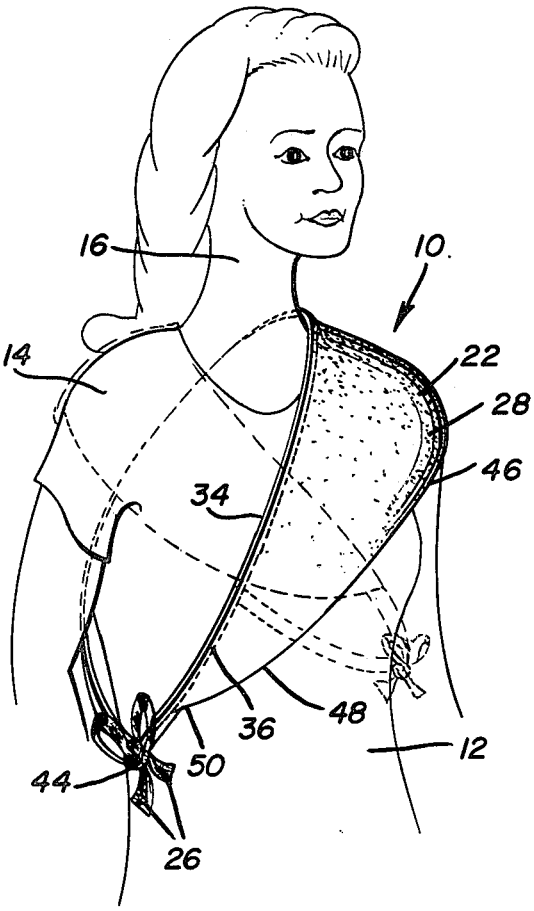
FIG. 1 is a perspective view of the shoulder protector of the present invention when used by a person burping a baby with the broken line illustration illustrating the alternative orientation over the opposite shoulder.

Referring now specifically to the drawings, the shoulder protector of the present invention is generally designated by reference numeral 10 and, as illustrated in FIG. 1, it is used by a person 12 by placing it over a shoulder region 14 with one edge of the protector adjacent the neck 16 and the opposite edge of the protector extending over the juncture between the upper arm portion and shoulder portion of the person using the device, thereby protecting the area of the shoulder which is adjacent to and subject to being soiled by liquid discharge from the mouth of an infant being burped while held in the normal position for this purpose, that is, with the head of the infant slightly above and facing the shoulder region. The protector covers the garments of the person using the device from being soiled by the liquid discharge from the mouth of the infant and also protects the infant from infection or contamination from clothing particularly when used in hospitals where one person may burp several infants in succession.

Figure 2:
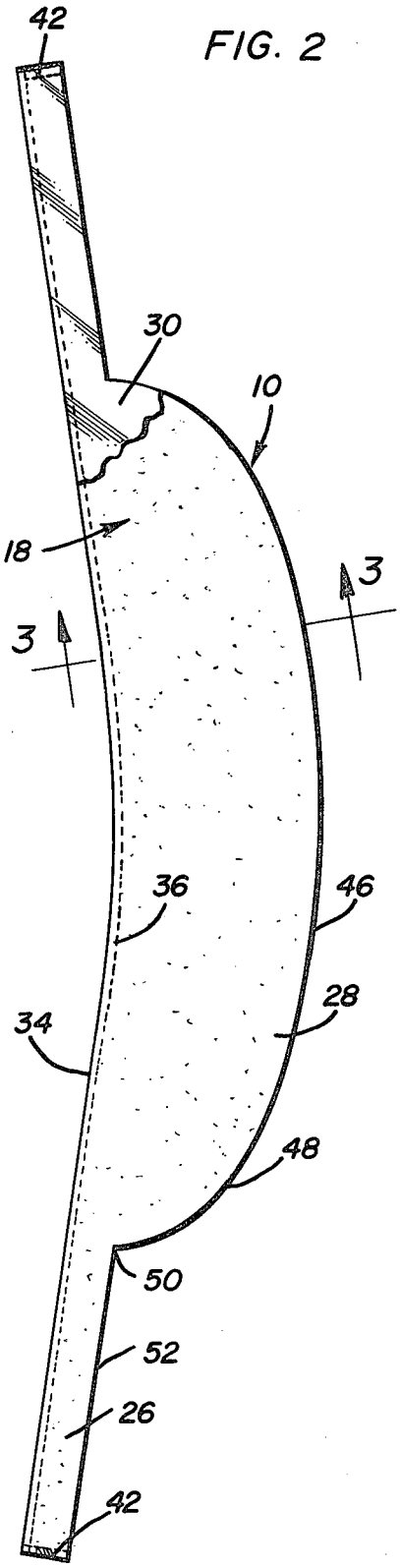
FIG. 2 is a top plan view of the shoulder protection with a portion of the upper absorbent layer broken away to illustrate the liquid impervious layer.

As illustrated in FIG. 2, the protector 10 includes a generally elongated flexible member generally designated by numeral 18 with the outer ends of the flexible member 18 including narrow extensions 26 which may be in the form of tie straps or securing straps to be used in a manner described hereinafter.

The flexible member 18 includes an upper layer 28 of absorbent paper or cloth material which is quite soft and highly absorbent thereby providing a soft comfortable surface on which an infant may rest his face or head and the absorbency characteristics of the upper layer 28 will effectively and quickly absorb any liquid discharged from the infant's mouth, such as when burping, drooling, or the like. Underlying the upper layer 28 is a lower layer 30 of liquid impervious material such as very thin plastic material which will preclude the liquid absorbed by the upper layer 28 from passing therethrough thereby protecting the underlying garments of the person 12 using the protector.

Figure 3:
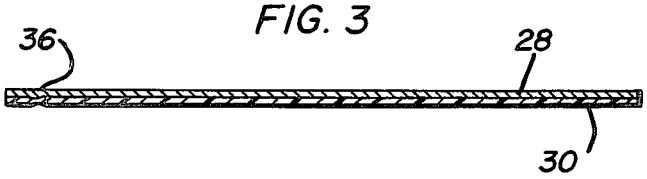
FIG. 3 is a transverse sectional view taken substantially upon a plane passing along section line 3—3 of FIG. 2 illustrating the relationship of the upper absorbent layer and the lower liquid impervious layer.

The inner edge 34 of the flexible member which faces the neck region 16 has the layers 28 and 30 laminated together by a heat seam, seal or stitching 36 which extends throughout the length thereof adjacent the inner edge 34 as illustrated in FIG. 3. The heat seal or seam is formed by applying heat and pressure along a continuous line which plasticizes the plastic layer 30 and secures the paper layer 28 thereto in a well-known manner. The layers 28 and 30 may also be stitched together by conventional stitching which may be the preferred arrangement when layer 28 is cloth. The layers 28 and 30 will be continuous from one end to the other of the flexible member 18. Also, the outermost ends of the straps 26 may be secured with a heat seam or stitching across the end edge portion 42 of the straps 26.

The straps 26 may be tied together to form a knot 44 or the ends thereof may be adjustably connected by various securing means, such as snaps, "Velcro", adhesive tape, buttons or any other well-known securing means used in the construction of garments. The edge 34 of the flexible member 18 is arcuately curved in the central region thereof and the outermost portions of the edge 34 are straight but oriented in angular relation to each other as illustrated in FIG. 2. The outer edge 46 of the flexible member 18 is also arcuately curved as illustrated in FIG. 2, but the other end portions of the outer edge 46 are arcuately curved, as at 48, along a much smaller radius, so that the terminal ends of the outer edge 46 including the portions 48 terminate as at 50 in longitudinally spaced relation from the ends of the straps 26 with the outer edge of each of the straps 26, designated by numeral 52, being substantially parallel to the inner edge 34 is illustrated in FIG. 2.

This construction provides a simplified protector which can be inexpensively manufactured in such a manner that the protectors can be disposable after a single use when the infant spits up, drools, or the like, thereby providing a sanitary and hygienic surface on which the infant can place his face and effectively protecting the garments of the person using the device.

The curvature of the inner and outer edges of the flexible member and the differences in the radius of curvature along the outer edge of the flexible member provides a fitted relationship to the shoulder with the outer edge of the flexible member extending around the outer region of the juncture between the arm and shoulder in more of a horizontal relationship than the arcuate inner edge of the flexible member with the outer edge of the flexible member more or less draping over the juncture between the shoulder and upper arm. This contoured or form-fitting arrangement thus maintains the protector securely in place and this construction enables the protector to be effectively disposed on either shoulder with either end of the protector oriented forwardly or rearwardly thereby facilitating use of the device.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shoulder protector for positioning over either shoulder of a person when engaged in holding or burping an infant, said protector comprising an upwardly exposed layer of liquid absorbing material of paper or cloth and an underlying layer of liquid impervious plastic material with the layers being coextensive and defining an elongated flexible member having a shallow concavely curved inner edge adapted to be disposed adjacent the neck region of a person using the protector and an arcuately curved outer edge depending around the juncture between the shoulder and upper arm area of the person using the protector, means at the ends of the protector for securing the ends thereof around the waist region of the person using the protector opposite to the shoulder region engaged by the protector, said plastic material being thermoplastic, said layers being joined together on one or more edges by a continuous laminated heat seam, said arcuate outer edge including end portions arcuately curved at a much smaller radius than the central portion with the end portions terminating in spaced relation to the ends of the protector thereby defining elongated narrow tie straps integral with the ends of the protector and forming a continuation of the inner edge portion of the flexible member, said means securing the protector adjacent the waist region opposite to the shoulder engaged by the protector including a knot securing the ends of the straps together.

* * * * *